US007438499B1

(12) United States Patent
Romano et al.

(10) Patent No.: US 7,438,499 B1
(45) Date of Patent: Oct. 21, 2008

(54) METHOD FOR PROTECTING PAVEMENT BORDERS DURING PAVING OPERATIONS

(75) Inventors: Joseph F. Romano, Valley Stream, NY (US); Nicholas T. Romano, Valley Stream, NY (US); Ann M. Romano, Valley Stream, NY (US)

(73) Assignee: Unique Ideas Corp., Valley Stream, NY (US)

( * ) Notice: Subject to any disclaimer, the term of this patent is extended or adjusted under 35 U.S.C. 154(b) by 0 days.

(21) Appl. No.: 11/463,334

(22) Filed: Aug. 9, 2006

Related U.S. Application Data

(60) Provisional application No. 60/707,126, filed on Aug. 10, 2005.

(51) Int. Cl.
*E01C 7/00* (2006.01)

(52) U.S. Cl. ..... 404/75; 52/746.1

(58) Field of Classification Search ..... 404/8, 404/18, 26, 31, 75; 52/741.6, 746.1, 741.3
See application file for complete search history.

(56) References Cited

U.S. PATENT DOCUMENTS

| | | | | |
|---|---|---|---|---|
| 1,665,206 | A | 4/1928 | Henry | |
| 3,603,221 | A * | 9/1971 | Barton et al. | 404/31 |
| 3,726,051 | A | 4/1973 | Kellis et al. | |
| 3,752,304 | A | 8/1973 | Alef | |
| 3,957,383 | A * | 5/1976 | Fredericks | 404/8 |
| 4,745,716 | A * | 5/1988 | Kuypers | 52/169.5 |
| 4,945,697 | A * | 8/1990 | Ott et al. | 52/403.1 |
| 5,421,041 | A | 6/1995 | Stern | |
| 5,441,769 | A | 8/1995 | Ross | |
| 5,694,723 | A * | 12/1997 | Parker | 52/169.5 |
| 5,771,643 | A * | 6/1998 | Parker | 52/169.5 |
| 5,800,648 | A * | 9/1998 | House et al. | 156/71 |
| 5,900,180 | A | 5/1999 | Scott et al. | |
| 6,122,887 | A * | 9/2000 | Massett et al. | 52/741.4 |
| 6,216,395 | B1 | 4/2001 | Kelly | |
| 6,489,022 | B1 | 12/2002 | Hamilton et al. | |
| 6,648,547 | B2 * | 11/2003 | Jones et al. | 404/31 |
| 6,713,522 | B2 | 3/2004 | Zhang et al. | |
| 6,822,012 | B1 | 11/2004 | Baumgart et al. | |
| 6,966,152 | B2 * | 11/2005 | Glynos | 52/4 |
| 7,059,800 | B2 * | 6/2006 | Jones et al. | 404/82 |
| 7,186,053 | B2 * | 3/2007 | Detzel | 404/8 |
| 2003/0035925 | A1 | 2/2003 | Holt | |
| 2005/0027024 | A1 | 2/2005 | Zhang et al. | |

* cited by examiner

*Primary Examiner*—Gary S Hartmann
(74) *Attorney, Agent, or Firm*—Michael J. Doyle

(57) ABSTRACT

A curb, brick, decorative block, landscaping tie or the like, installed between a border area and a paving area can be protected from damage and soiling caused by paving operations by the installation of a flexible protective film, such as a web of polymer film, surrounding the exposed surfaces of the curb border. The flexible protective film extends next to and preferably away from the curb border onto a foundational underlayment surface and beneath the paving surface, thereby effectively securing and sealing a portion of the flexible film with the pavement. After paving is completed, the used and soiled flexible protective film is loosened from the curb border after the paving operation and is fully removed by cutting, tearing or lifting it away from the curb-paving interface thereby leaving a clean and attractive curb-paving border.

15 Claims, 5 Drawing Sheets

METHOD FOR PROTECTING PAVEMENT BORDERS DURING PAVING OPERATIONS

CROSS-REFERENCE TO RELATED APPLICATIONS

This application claims the benefit of provisional patent application Ser. No. 60/707,126, filed Aug. 10, 2005 by the present inventors.

FEDERALLY SPONSORED RESEARCH

Not Applicable

SEQUENCE LISTING OR PROGRAM

Not Applicable

BACKGROUND OF THE INVENTION

1. Field of Invention

This invention relates generally to the field of paving and related landscaping operations and provides improved methods for protecting functional or decorative border items such as brickwork, curbing, stamped or colored concrete and the like, thereby achieving a clean and attractive paving-border area.

2. Prior Art

Prior paving operations create borders for defining pavement areas but these are invariably spoiled when paving materials or sealer are applied in close proximity. Decorative borders are occasionally ruined in such operations.

When working with paving materials such as concrete, masonry or asphalt near functional or decorative borders such as bricks or curbing, the borders invariably end up covered in paving material which is not only unsightly but also difficult and time consuming to remove. Even when the border is brushed clean, it still remains soiled with cement or asphalt particles. Customers paying large sums of money for paving and landscaping are not satisfied when their project is soiled by the paving material.

3. Objects and Advantages

Accordingly, we have determined that it is desirable to provide a system for protecting the surface of curb borders adjacent to paving operations. We have also determined that it is desirable to provide a method for installing a flexible protective film for protecting such curb borders which is readily removed after installation of the paving material, thereby providing a clean and attractive finished paving project.

In addition, we have determined that it is desirable to provide means for applying and removing a flexible protective film or wrap in a paving project to avoid time consuming clean-up operations while providing an attractive end product.

Those skilled in the art will appreciate that the conception upon which this disclosure is based may readily be utilized as a basis for the designing of other methods and systems for carrying out the several purposes of the present invention. The claims should be regarded as including such equivalent constructions which do not depart from the spirit and scope of the present invention.

SUMMARY

The method of installing pavement adjacent to a fixed border material is improved by the steps of protecting the border material by covering it with a flexible protective film prior to the paving operation; installing the pavement material up to the border position and thereby securing or sealing the flexible protective film horizontally beneath a portion of the pavement edge nearest the border material, as well as securing or sealing a portion of the film vertically between the pavement edge and the border material. After the paving operation is completed, the used or soiled flexible protective film is removed from the border material, providing a clean and attractive paving-border area or interface.

The border material may be decorative or functional curbing, brick, tile, blocks, landscaping ties, or wooden, plastic or metal border materials. This technique will work equally well on bricks, stone or cast blocks such as Belgian blocks, wooden ties typically used in landscaping applications, other wooden or plastic border materials, concrete curbing and other functional or decorative borders including colored and/or stamped concrete edging.

The paving material is generally either concrete, masonry or asphalt pavement. The present paving system will work equally well with paving stones, slate, and tile, as well as with asphalt sealing operations. Often it will be preferred to prepare the pavement area with a foundational layer (an underlayment) such as gravel, stone, sand, etc.

The flexible protective film material will have sufficient strength and heat resistance for a given application and is preferably a plastic film such as saran (poly-vinylidene chloride) or polyethylene. Other plastic films having adequate strength and heat resistance may be utilized in appropriate applications.

The flexible protective film is generally fastened to the border material by stretch wrapping, or with some preferred films, by gripping or sealing mechanisms built into the plastic film surface. The use of glue or resin tacking or adhesive tape is generally not necessary or preferred.

The important features of the invention have been broadly outlined so that the detailed description that follows may be better understood, and in order that the present contribution to the art may be better appreciated. There are, of course, additional features of the invention that will be described below and which will form the subject matter of the claims.

It is to be understood that the invention is not limited in its application to the details of the methods and materials of construction set forth in the following description or illustrated in the drawings. The invention is capable of other embodiments and of being practiced and carried out in various ways.

DRAWINGS

Figures

DETAILED DESCRIPTION

Preferred Embodiments

Figure 1:
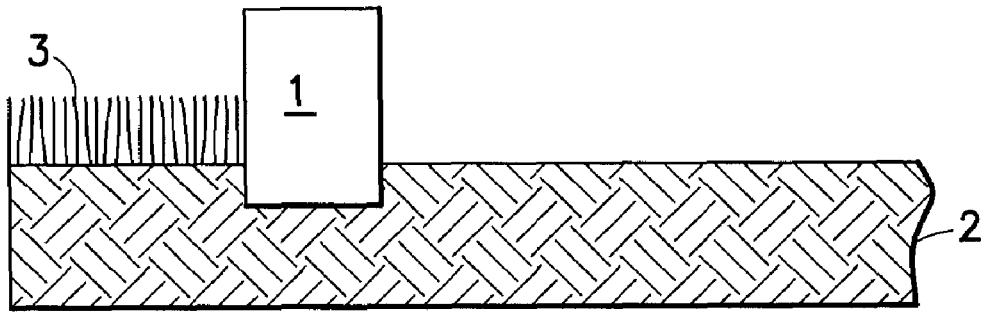
FIG. 1 PRIOR ART
FIGS. 1 and 2 are cross-sectional views of an area prepared for a paving operation as practiced in the Prior Art.

A curb, brick, decorative block, landscaping tie or the like, installed adjacent a paving area, can be protected from damage and soiling caused by the paving operations by the installation of a flexible protective film surrounding the exposed surfaces of the curb border. The flexible protective film covers the curb border and preferably extends away from the curb border onto the foundation underlayment surface and partially beneath the subsequently installed paving surface, thereby effectively securing or sealing a portion of the film next to or below the pavement. The used, soiled flexible protective film is loosened from the curb border after the paving operation and is removed by cutting, tearing or lifting it away from the curb-paving interface thereby leaving a clean and attractive curb border.

Rolls or sheets of sufficiently heavy gauge flexible film is stretched and affixed to the border area before the pavement is poured. Film with gripping properties is applied to conform to the shape of the border to be protected. The heat resistance of the selected protective film is less important in concrete paving applications than it would be for asphalt paving. The preset method will work equally well in asphalt sealing operations. Again, the used flexible protective film is thereafter removed from the border area, keeping the border intact without concrete or asphalt spots or debris.

The flexible protective film covering used in the present invention is preferably plastic film, particularly any of the various polyethylene and polyvinyl or polyvinylidene chloride films, such as those commercially available under the Glad, Handi-Wrap, Reynolds Plastic Wrap and Saran tradenames. Glad Press'n Seal® wrap using GRIPTEX® brand textured surface gripping and sealing technology is the most preferred flexible protective film material due to its strength, gripping ability and ease of handling which may be characterized as preventing inadvertent adherence. Press'n Seal® wrap sticks only when it is deliberately pressed onto a surface as described in U.S. Pat. No. 6,489,022 to Hamilton, et al. which is incorporated herein by reference.

The gauge of the selected film is determined by a balance between strength, stretchiness and gripping ability. Insufficient thickness will cause undue tearing whereas a film which is too thick will lack adequate flexibility. Suitable plastic films range in thickness from about 0.5 mil to 1.5 mil, but other thicknesses may be employed under differing circumstances. It is desirable that the film have sufficient strength to perform well in the present system without being too heavy or unwieldy during handling. When the paving material of choice is asphalt, the film should have sufficient heat strength to perform well in the paving system.

Plastic films which generally exhibit a large degree of grip or stretchiness will physically adhere to the border without the necessity of glue or resin tacking. Static electricity might be employed to secure the film but this would not be preferred since the other plastic films perform so well.

It is contemplated that the flexible protective film may be readily applied manually in rolls or sheets, as may be appropriate for a particular paving or landscaping project. However, tools and applicators such as rollers, trowels and the like may be usefully employed.

FIG. 1 depicts a cross-sectional view of a curb 1, which will border a paving area and which may also be a brick or decorative block or the like. Block or curb 1 is installed in the earth 2 between a lawn area 3 on one side of the curb border and a paving area on the opposite side of the curb border. In commercial practice, the lawn area depicted in FIG. 1 may also be a landscaped area or another paved or bricked area such as a walkway and the like.

Figure 2:
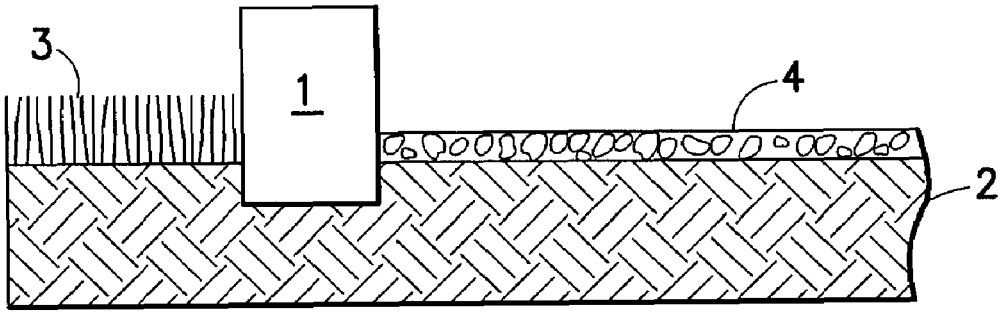
FIG. 2 PRIOR ART

FIG. 2 further depicts the preparation of the paving area, in this case by installing a suitable underlayment surface 4, such as a gravel foundation, for receiving subsequently installed paving material.

Figure 3:
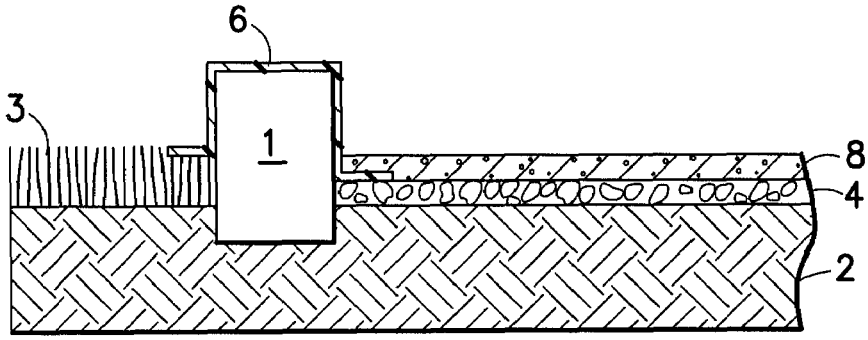
FIGS. 3-5 are cross-sectional views of a paving operation utilizing the method and materials of the present invention.

FIG. 3 depicts the method and materials of the preset invention and depicts the installation of a flexible protective film 6 upon the exposed surfaces of curb border 1. The flexible protective film 6 will desirably extend away from the curb border 1 onto the underlayment surface 4 and therefore will be located underneath the paving surface 8 which is installed next. The paving surface 8 is typically concrete, masonry or asphalt. The flexible protective film 6 will desirably cover the entire exposed surface of the curb border 1 but may extend further onto the lawn 3 or other adjoining surface. FIG. 3 depicts the installed paving surface 8 atop the underlayment 4 and running up to the curb border which nonetheless remains covered with the protective film 6, thereby effectively securing or sealing a portion of the protective film 6 against a vertical portion of the film between the paving 8 and the curb border 1, and preferably below a portion of paving 8 as well. Typically it will be seen that areas of the flexible protective film 6 will become soiled with excess paving material and splatter during the installation of paving surface 8.

Figure 4:
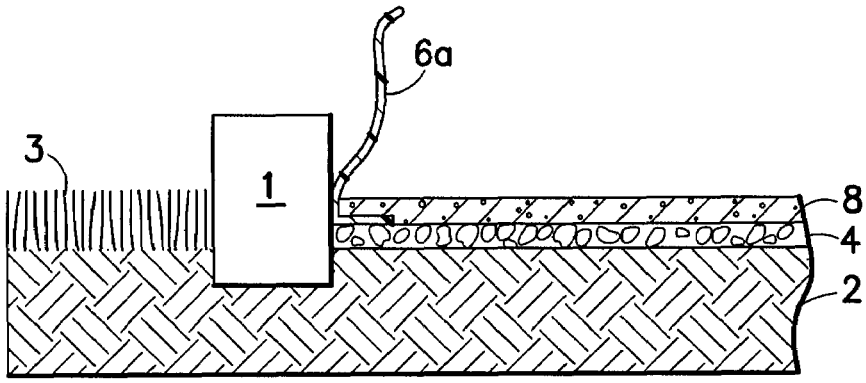

In FIG. 4, the removal of soiled flexible protective film **6*a* is begun by loosening it from the curb border 1 after the paving operation is completed, but prior to the complete removal of the soiled flexible protective film 6*a*. At this point, the soiled flexible protective film 6*a* remains temporarily sealed or secured under a portion of the paving surface material 8, as well as between the paving surface material 8 and the curb border 1. Thereafter, the soiled flexible protective film 6*a*** may then be completely removed by cutting, tearing or lifting it away from the curb-paving interface, as may be appropriate in the circumstances.

Figure 5:
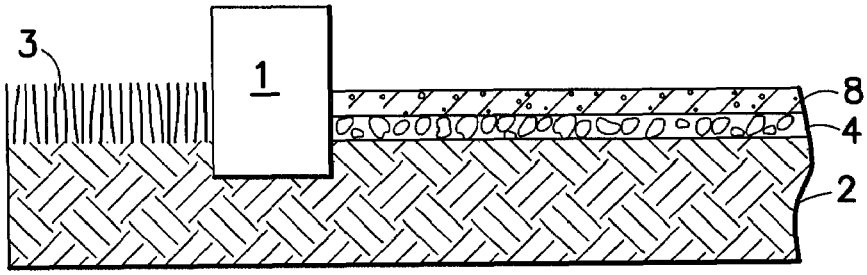

FIG. 5 depicts a cross section of the final curb and paving project wherein the curb block 1 has been protected during the installation of paving surface 8. Remnants, if any, of the flexible protective film are not seen.

Figure 6:
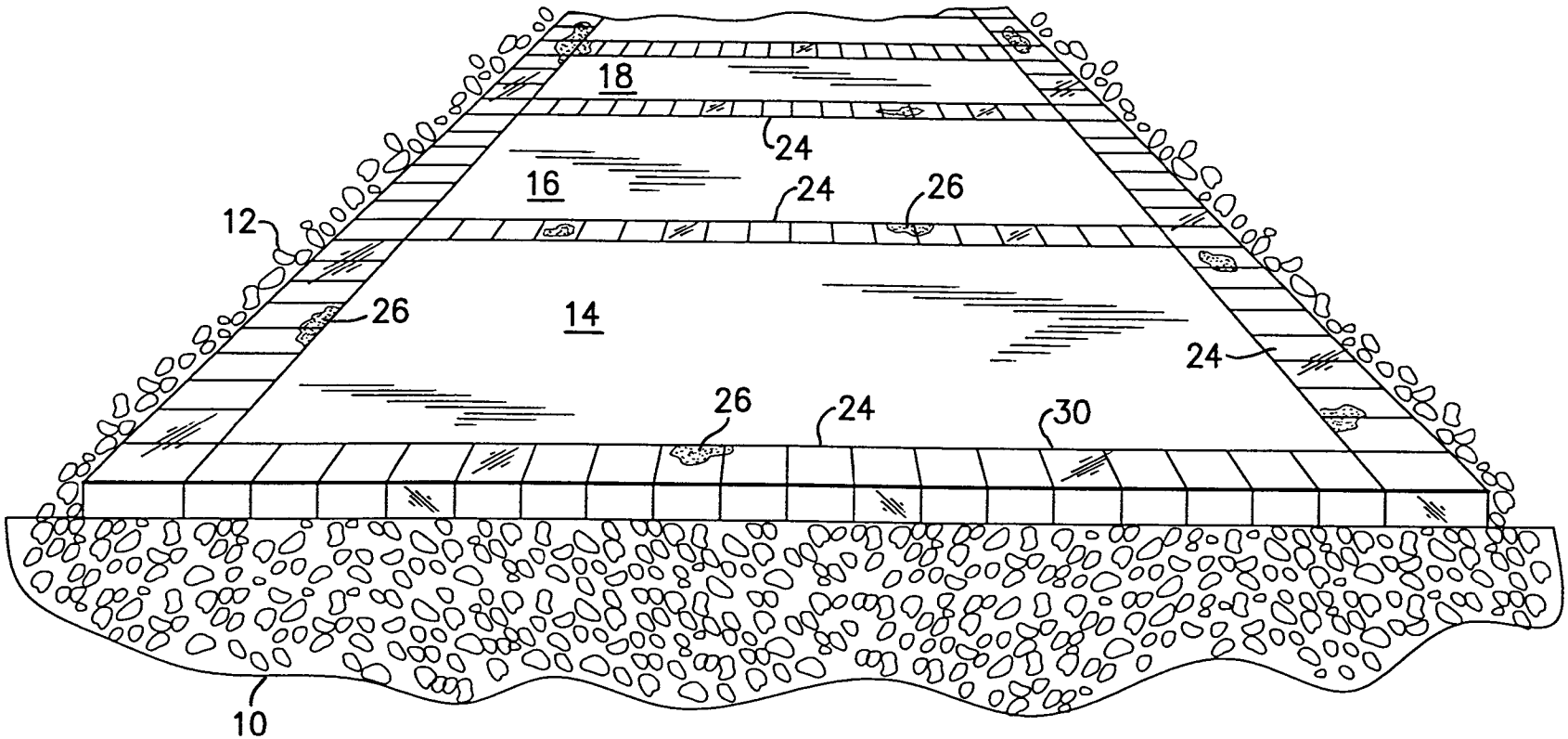
FIGS. 6-7 are perspective views of an area undergoing a paving operation in accordance with the method and materials of the present invention.

FIG. 6 depicts a perspective view of a paving operation in progress. Paved areas 14, 16 and 18 are bordered by rectangular forms comprised of covered decorative blocks 24. Gravel foundation underlayment 10 will be used in a subsequent paving operation. Peripheral gravel 12 is a remnant of the current paving operation. In FIG. 6 it is to be understood that decorative blocks 24 are covered by a transparent flexible protective film 30, which in this embodiment is suggested by the shading element. The operation which has paved areas 14, 16 and 18 has left numerous unsightly splotches and remnants 26 of the paving materials.

Figure 7:
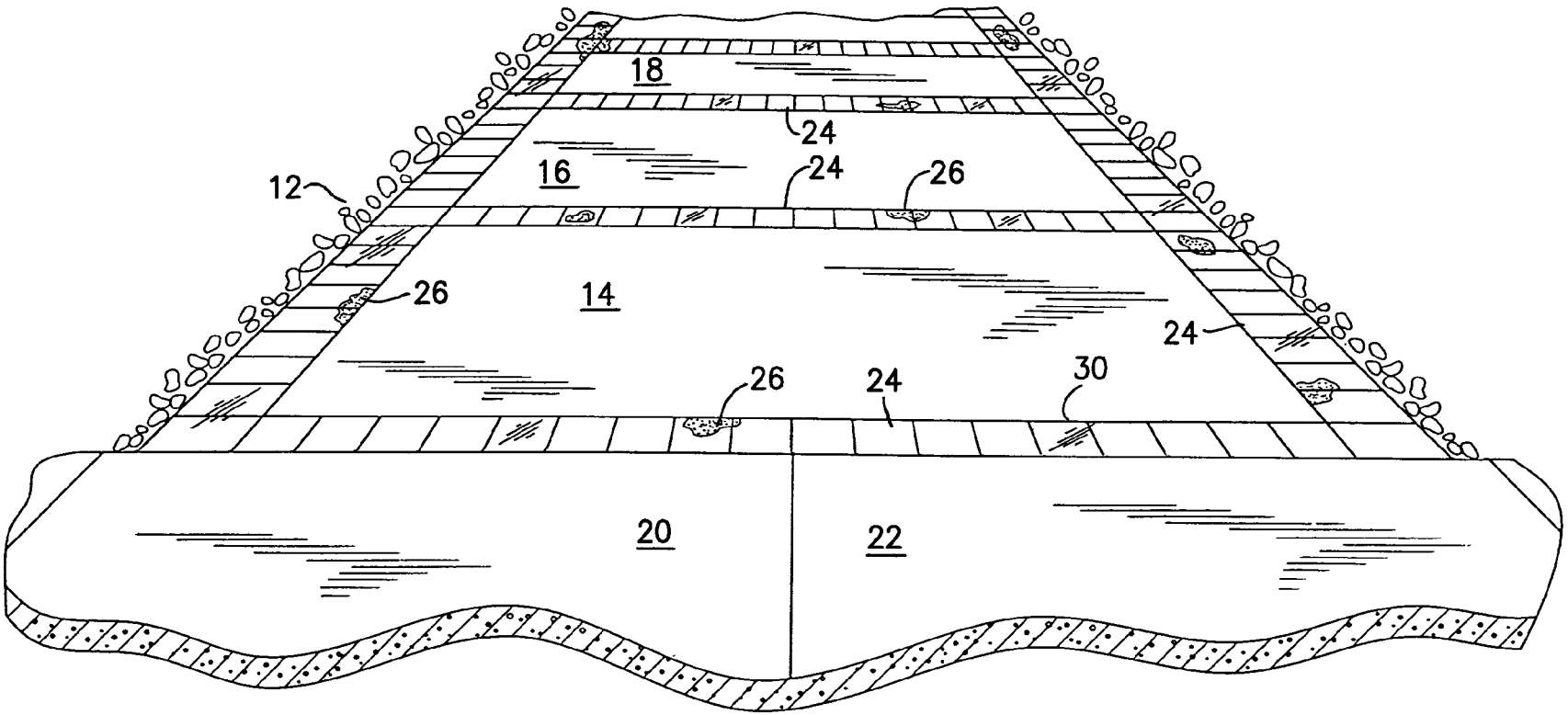

FIG. 7 depicts a continuation of the paving operation of FIG. 6 wherein foreground paving surfaces 20 and 22 have been installed and which abut the vertical edge of the decorative bricks 24 which remain covered with transparent flexible film 30 and which has been soiled with remnant paving material 26. A portion of transparent flexible film 30 is secured between decorative blocks 24 and newly paved areas 20 and 22.

Figure 8:
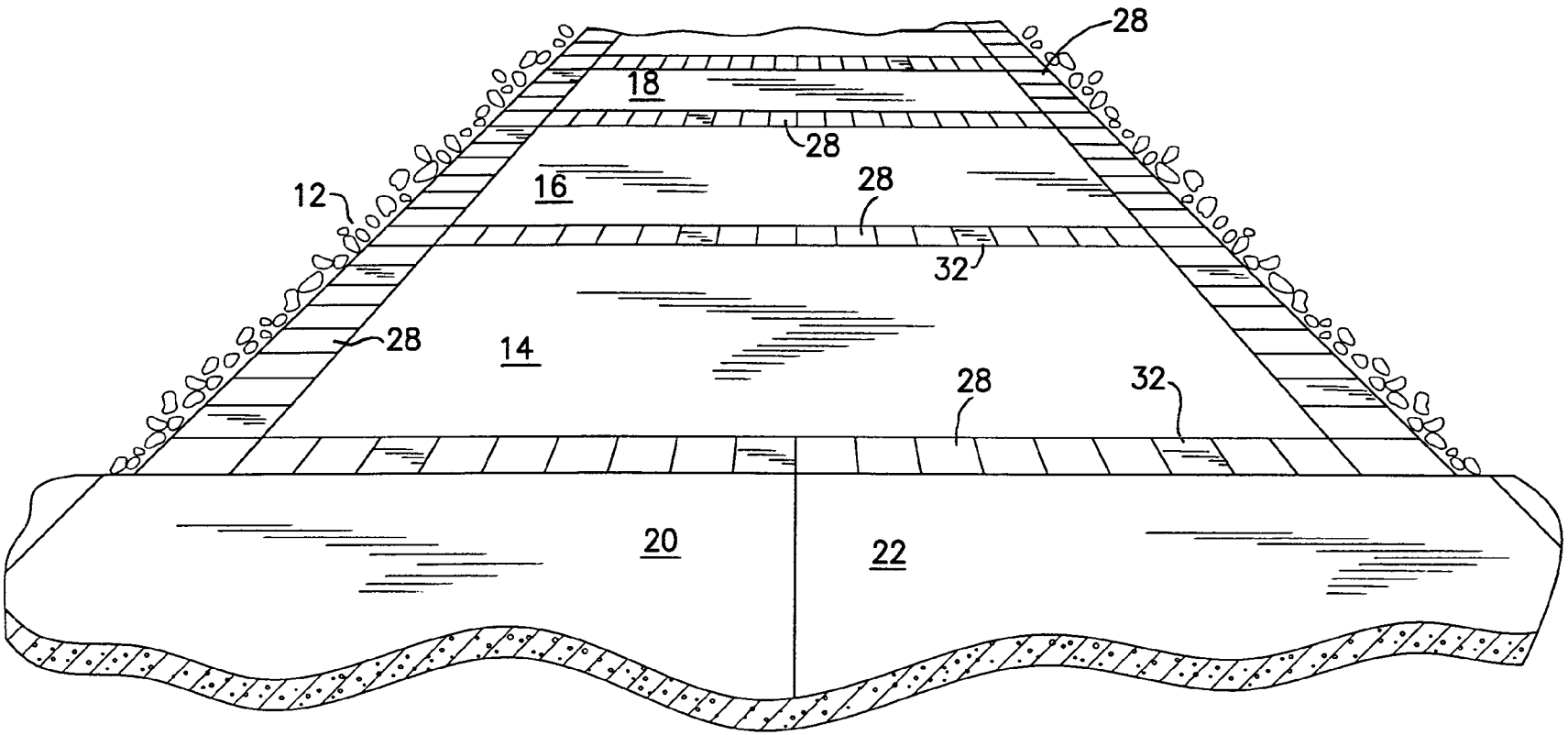
FIG. 8 is a perspective view of an area which has been paved in accordance with the method of the present invention.

FIG. 8 depicts a perspective view of the end result of the foregoing paving operation wherein the paved areas 14, 16, 18, 20 and 22 are bordered on several sides by clean decorative bricks 28, as suggested in this drawing by hatching element 32.

Many features and advantages of the invention are apparent from the detailed specification, and thus, it is intended that the appended claims cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents falling within the scope of the invention may also be utilized.

What is claimed is:

1. In a method of installing pavement adjacent to a fixed border material, the improvement comprising the steps of:

preparing a paving area adjacent the border with a foundational underlayment for receiving paving material;

protecting exposed surfaces of the border material by covering said border material with a flexible protective film fastened to the border material prior to a paving operation wherein the protective film conforms to the surface of the border material and extends away from the border material onto the foundational underlayment and wherein the flexible protective film is fastened to the border material by pressure sensitive adhesive;

installing pavement up to the border position thereby securing a portion of the flexible protective film horizontally beneath the pavement edge nearest the border material and vertically between the pavement and the border material; and loosening and removing the flexible protective film from the border material-paving interface after the paving operation is completed, thereby providing a clean and attractive paving-border area.

2. A method as in claim 1 wherein the border material is selected from the group consisting of curbing, brick, tile, blocks, decorative concrete, landscaping ties and wooden, metal or plastic border trim.

3. A method as in claim 1 wherein the paving material is selected from the group consisting of concrete, asphalt pavement and asphalt sealant.

4. A method as in claim 1 wherein the foundational underlayment is an area abutting the border material and prepared for receiving the paving material.

5. A method as in claim 4 wherein said foundational underlayment is selected from the group consisting of gravel, stone and sand.

6. A method as in claim 1 wherein the flexible protective film material is a polymer film selected from the group consisting of polyethylene film and polyvinyl film.

7. A method as in claim 1 wherein the flexible protective film is fastened to the border material by stretch wrapping, glue tacking, adhesive or adhesive tape.

8. In a method of installing pavement adjacent to a fixed border material, the improvement comprising the steps of:

preparing a paving area adjacent the border with a foundational underlayment for receiving paving material;

protecting exposed surfaces of the border material by covering said border material with a flexible protective film fastened to the border material prior to a paving operation wherein the protective film conforms and grips to the surface of the border material and extends away from the border material onto the foundational underlayment and wherein the flexible protective film grips and adheres to said border material by fastening and sealing mechanism selected from stretch wrapping, glue tacking, adhesive or adhesive tape;

installing pavement up to the border position thereby securing a portion of the flexible protective film horizontally beneath the pavement edge nearest the border material and vertically between the pavement and the border material; and loosening and removing the flexible protective film from the border material-paving interface after the paving operation is completed, thereby providing a clean and attractive paving-border area.

9. A method as in claim 8 wherein the border material is selected from the group consisting of curbing, brick, tile, blocks, decorative concrete, landscaping ties and wooden, metal or plastic border trim.

10. A method as in claim 8 wherein the paving material is selected from the group consisting of concrete, asphalt pavement and asphalt sealant.

11. A method as in claim 8 wherein the foundational underlayment is an area abutting the border material and prepared for receiving the paving material.

12. A method as in claim 11 wherein said foundational underlayment is selected from the group consisting of gravel, stone and sand.

13. A method as in claim 8 wherein the flexible protective film material is a polymer film selected from the group consisting of polyethylene film and polyvinyl film.

14. A method as in claim 8 wherein the flexible protective film which grips and adheres to said border material stretch wrapping and sealing film.

15. A method as in claim 8 wherein the flexible protective film is fastened to the border material by pressure sensitive adhesive.

* * * * *